US005601230A

United States Patent [19]

Bell

[11] Patent Number: 5,601,230

[45] Date of Patent: Feb. 11, 1997

[54] INTEGRATED PACKAGING AND FUNNEL CONSTRUCTION

[75] Inventor: Jackie E. Bell, Racine, Wis.

[73] Assignee: Union Camp Corporation, Wayne, N.J.

[21] Appl. No.: 573,028

[22] Filed: Dec. 15, 1995

[51] Int. Cl.[6] ..... B65D 5/42

[52] U.S. Cl. ..... 229/103; 141/337; 206/216

[58] Field of Search ..... 229/103, 116.1; 206/216, 223; 141/337, 338

[56] References Cited

U.S. PATENT DOCUMENTS

| | | | |
|---|---|---|---|
| 3,037,682 | 6/1962 | Daubert | 229/103 |
| 3,100,642 | 8/1963 | Goldstein | 229/103 |
| 3,568,891 | 3/1971 | Parish . | |
| 3,633,794 | 1/1972 | Croley . | |
| 3,841,479 | 10/1974 | Szatkowski . | |
| 4,043,502 | 8/1977 | Croley . | |
| 4,055,292 | 10/1977 | Hosoya | 229/103 |
| 4,125,218 | 11/1978 | DeBoer | 229/103 |
| 4,169,548 | 10/1979 | Bond . | |
| 4,318,497 | 3/1982 | Friedrich . | |
| 4,330,072 | 5/1982 | Mastman . | |
| 4,380,289 | 4/1983 | Bigelow | 206/216 |
| 4,415,100 | 11/1983 | Hutchinson . | |
| 4,648,548 | 3/1987 | Shin | 229/103 |
| 4,696,398 | 9/1987 | Steinmetz, Jr. . | |
| 4,895,250 | 1/1990 | Schifrin | 206/223 |
| 4,913,292 | 4/1990 | Field . | |
| 4,969,596 | 11/1990 | Schulbaum . | |
| 5,110,038 | 5/1992 | Pantisano et al. | 229/103 |
| 5,156,266 | 10/1992 | Sykora | 206/216 |
| 5,255,841 | 10/1993 | Ritter | 229/103 |
| 5,398,871 | 3/1995 | Vescio . | |
| 5,420,775 | 5/1995 | Kusmer | 229/103 |

*Primary Examiner*—Gary E. Elkins

*Attorney, Agent, or Firm*—Aufrichtig Stein & Aufrichtig, P.C.

[57] ABSTRACT

An integrated packaging system, including a funnel, for containers of motor oil or other pourable materials. The packaging system is formed into a box out of a sheet of material, such as corrugated cardboard. One or more walls of the cardboard are partially die cut to allow selective removal of a section, with fold lines pre-stamped, which when folded form a funnel. The funnel is convenient, included as a part of the box, storable within the box and recyclable with the box when discarded.

30 Claims, 5 Drawing Sheets

INTEGRATED PACKAGING AND FUNNEL CONSTRUCTION

BACKGROUND OF THE INVENTION

The invention is generally directed to an integrated package and funnel constructed from corrugated cardboard or similar sheet material and in particular to a container adapted to hold a series of cans or bottles of motor oil and a funnel integrally formed in the container to be removed and utilized in connection with pouring out the oil into a car's crank case.

In the past people have purchased motor oil to add more oil as necessary to their cars and trucks and to perform oil changes as needed. Generally, the oil comes in cans or bottles and must be then poured into a small opening in the crank case. Generally, the opening is not found in a convenient spot to pour the motor oil. Rather, the person pouring the oil must lean over the opened hood of the car or truck and then pour from the can or bottle. Particularly with respect to cans, bottles, soft pack plastic containers or other motor oil lubricant containers, common forms of transporting motor oil, there is a high likelihood of spillage and difficulty in getting the motor oil into the opening in the crank case. When the person is changing the oil and must pour in four or five or even six quarts of motor oil, the spillage and messiness problem associated with pouring is particularly troublesome.

Generally, people have had to purchase funnels, generally made out of plastic or metal. While this solves the problem of pouring, so that the oil does not spill and drip other than where it is supposed to go, this requires the user to purchase and then retain the funnel. The metal or plastic funnels that are in use present other problems. Because of the viscosity of the oil some portion of the oil sticks to the funnels for a considerable period of time and, in practice, the funnels must be stored carefully in an upright position, generally in another container so that the oil does not drip onto the floor or whatever it rests on. Also, while people often keep one or more quarts of oil in their car in the event of emergencies on the road, they generally do not have their funnels with them as the funnels tend to soil the trunk or other areas of the car in which they are stored.

Other approaches to this problem have been to create openings for valves in the cans or to provide long neck bottles for the motor oil. While these approaches have been useful they add substantially to the cost of packaging and delivery of the oil, thereby unduly increasing the expense to the consumer and fail to work as well as funnels. Also, these other adaptions make recycling of the motor oil container more expensive and difficult.

Accordingly there is a need for an improved package and container including an integrated funnel system for motor oil cans and bottles which provides the benefit of simplifying motor oil addition and changing without the need for a separate funnel and without the need to store a funnel apart from the motor oil.

SUMMARY OF THE INVENTION

The invention is generally directed to an integrated packaging system for containers of pourable materials including top, bottom, side and end panels forming a box for enclosing the pourable material and a funnel assembly formed from one of the panels for forming a funnel to aid in pouring the pourable materials from the containers, where the funnel assembly is removable from the panel and has fold lines to fold into a frustumated pyramidal shape.

The invention is also directed to an integrated pre-cut container incorporating an integrated funnel formed on one of the surfaces of the container for selective removal and assembly for use in pouring motor oil into a car's or truck's crank case.

It is a goal of the invention to provide an improved funnel for use with motor oil which is formed out of the container in which the motor oil is shipped and sold to the consumer.

Another goal of the invention is to provide an improved shipping and point of sale container for motor oil and similar liquids incorporating a funnel die cut out of the surface of the container.

Still another goal of the invention is to provide an improved container for transporting, shipping and selling a series of bottles of motor oil or other liquid or pourable powder in cans or bottles in which one surface of the container may be removed to allow dispensing of the bottles of cans from within the container and forming a funnel to aid pouring the motor oil or other liquid into its intended receptacle.

Still another goal of the invention is to provide an improved corrugated cardboard box having a funnel shape die cut into the top surface of the box so that upon removal of the die cut funnel shape from the top surface of the box the bottles or cans inside can be removed and the die cut funnel shape can be assembled to form a funnel for pouring the liquid into its intended receptacle.

Yet a further goal of the invention is to provide an improved funnel formed of corrugated cardboard with a protective layer to aid in pouring motor oil into the crank case when the funnel is formed integrally as a portion of the wall of the container for the motor oil.

Yet still a further goal of the invention is to provide an improved container for shipping motor oil which is consumer friendly, containing six cans or bottles of motor oil and which may be opened by removing a die cut funnel formed from the top surface of the container to allow easy access and removal of the bottles or cans inside and then assembling the funnel to aid in pouring the motor oil into the crank case of a car or truck.

Yet another goal of the invention is to provide an improved motor oil box and funnel set which can be safely and cleanly transported and retained by the consumer so that separate storage of a dirty funnel is not required.

Still a further goal of the invention is to provide a complete motor oil delivery system formed of a box having a portion of one surface opening to provide access to the cans or bottles stored inside and the open side having a wedge formed from the box material so that easy pouring and convenient storage of the funnel are achieved.

Yet a further goal of the invention is to provide a funnel integrated into a motor oil can or bottle box which may be utilized and then recycled with the box.

Still other objects and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
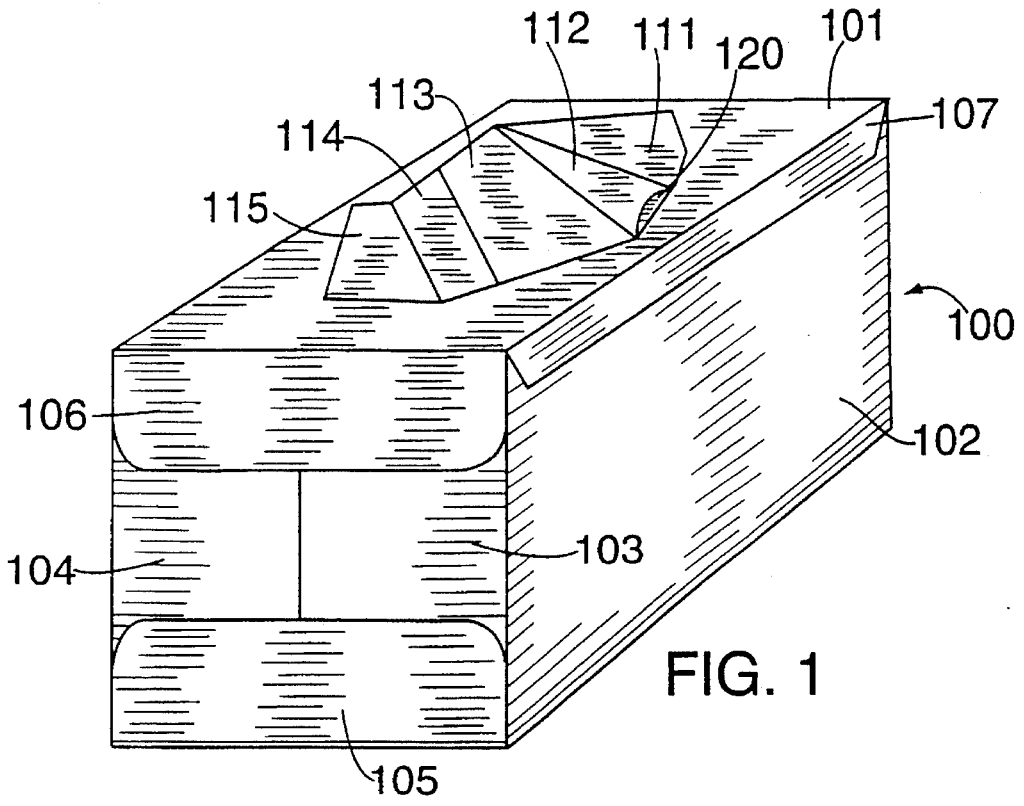
FIG. 1 is a prospective view of the container with an integrated funnel constructed in accordance with a preferred embodiment of the invention.
Figure 3:
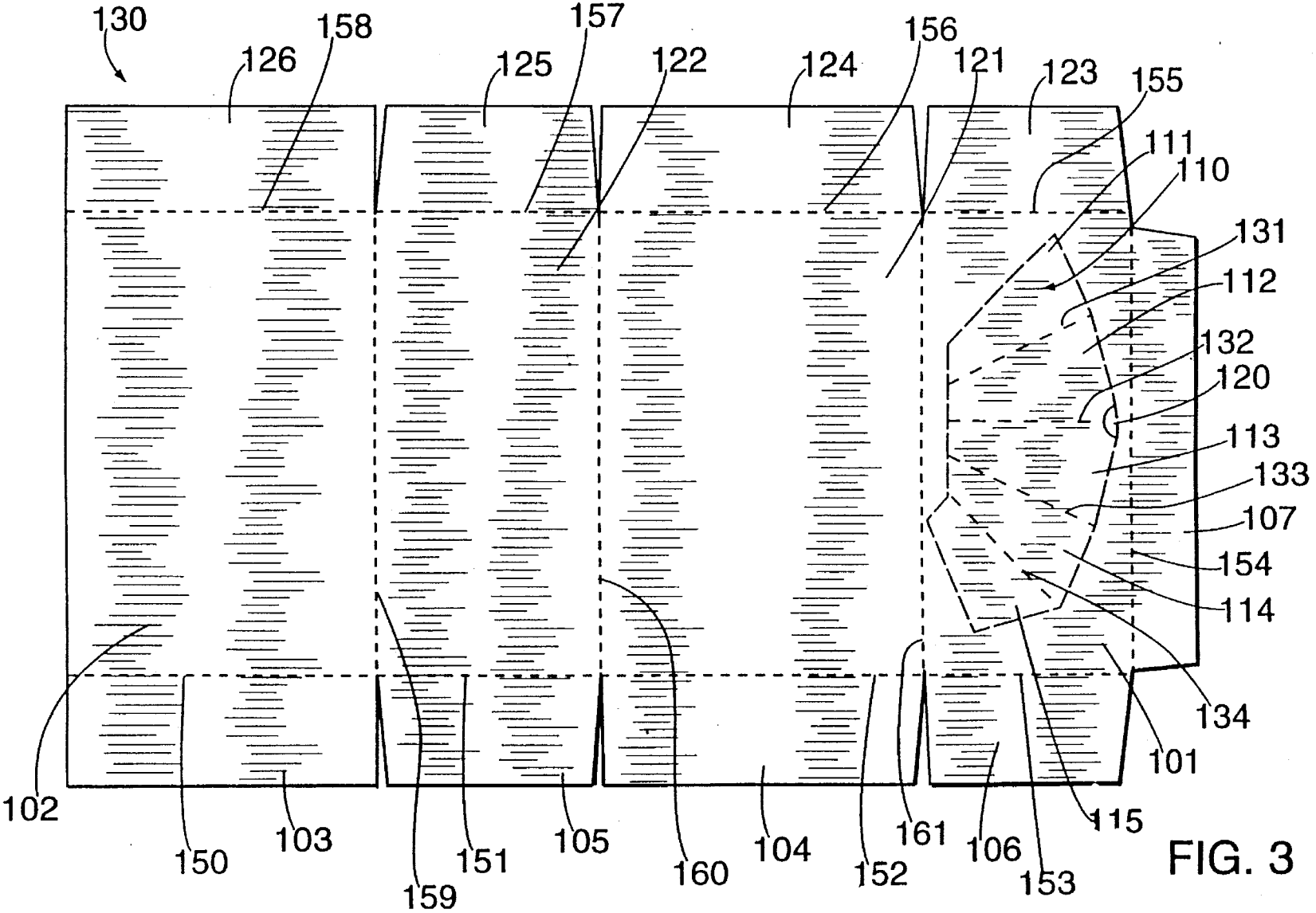
FIG. 3 is a top plan view of a die cut blank for assembly into the container of FIG. 1.

Reference is first made to FIGS. 1 and 3 wherein an integrated packaging construction in accordance with a preferred embodiment of the invention, generally indicated as 100 is depicted. As better seen in FIG. 1, the construction is a box 100 having a top surface 101, side surface 102, vertical end panels 103, 104, horizontal end panels 105, 106 and side flap 107. The funnel assembly, generally indicated as 110 is die cut and formed as a part of construction top 101. The funnel assembly 110 includes sections 111, 112, 113, 114 and 115. In addition, a semi-circular die cut section 120 is adapted to be pushed inward and provide a gripping surface for removing funnel assembly 110 from top surface 101.

As better seen in FIG. 3 which represents the die cut sheet forming integrated packaging funnel construction 100, there are additional surfaces and pre-stamped fold lines. Not seen in FIG. 1 are vertical end panels 124, 126 and, horizontal end panels 123, 125, side panel 121 and base panel 122, which are the other surfaces of box 100. As seen in FIG. 1 the construction 100 forms a generally rectangular box which is sized to receive and hold a number of cans or bottles of motor oil or other liquid.

In addition to the surfaces identified above, there are a series of pre-stamped fold lines which enable the die cut form to be folded into its finished shape. These include fold line 150 between side surface 102 and end section 103, fold 151 between horizontal end section 105 and base 122, fold line 152 between vertical end section 104 and side surface 121, fold line 153 between horizontal end section 106 and top surface 101, fold line 154 between top side flap 107 and top surface 101, fold line 155 between horizontal end section 123 and top section 101, fold line 156 between end section 124 and side panel 121, fold 157 between bottom panel 122 and horizontal end flap 125, fold 158 between side panel 102 and vertical end panel 126, fold 159 between side panel 102 and base panel 122, fold line 160 between side panel 121 and base panel 122, and fold line 161 between top panel 101 and side panel 121.

In addition, wedge assembly 110 has fold line 131 between panels 111 and 112, fold line 132 between panels 112 and 113, fold line 133 between panels 113 and 114, and fold line 134 between panels 114 and 115.

The container 100 is formed from the die cut panel, generally indicated as 130, by folding panels along the pre-established fold lines and then connecting surfaces by gluing, ultrasonic bonding or other conventional box assembly methods. In a preferred embodiment the panel 130 is formed of corrugated cardboard. First, vertical end panels 103, 104, 124 and 126 are folded at a right angle to adjacent side panels 102, 121 along fold lines 150, 152, 156 and 158, respectively. Next, side panel 102 is rotated to a generally vertical orientation about fold line 159 and side panel 121 is rotated to a generally vertical orientation about fold line 160. This has the effect of creating an open topped box assembly in which panels 102 and 121 form the side panels of the box and panel 122 forms the base. Vertical side panels 103, 104, 124 and 126 form the ends of the box. The free ends of these vertical end panels opposite to the respective fold lines mate in abutting relationship with the adjoining vertical end panel. Together, vertical end panels 103 and 104 form one end wall of the box and end panels 124 and 126 form the other end panel. Next, top panel 101 is folded downwardly about fold line 161 to form a top to the box. Next, horizontal end flaps 105, 106, 123 and 125 and horizontal top flap 107 are folded along fold lines 151, 153, 155, 157 and 154 respectively into for the finished box form. End flaps 104, 105, 124, 125 and 107 are then secured in place by gluing, ultrasound connection or other conventional connection techniques to form the completed box form.

In practice, prior to rotating top panel 101 down on top of the box to seal it, the contents of the box cover such as cans of motor oil (not shown) are inserted into the partially finished box. Generally, only bottom end flaps 105 and 125 have been secured to vertical end flaps 103, 104 and 124, 126, respectively, prior to the placement of the motor oil into the container. Thereafter, after the motor oil is placed within the container the top panel 101 and end flaps 106 and 123 and horizontal top flap 107 can be glued in place to complete the box.

Alternatively, the motor oil can be placed directly unto base panel 122 prior to any assembly occurring and then the box can be assembled around the motor oil. The preferred approach depends upon the assembly line equipment present in a user's manufacturing and production line.

Figure 4:
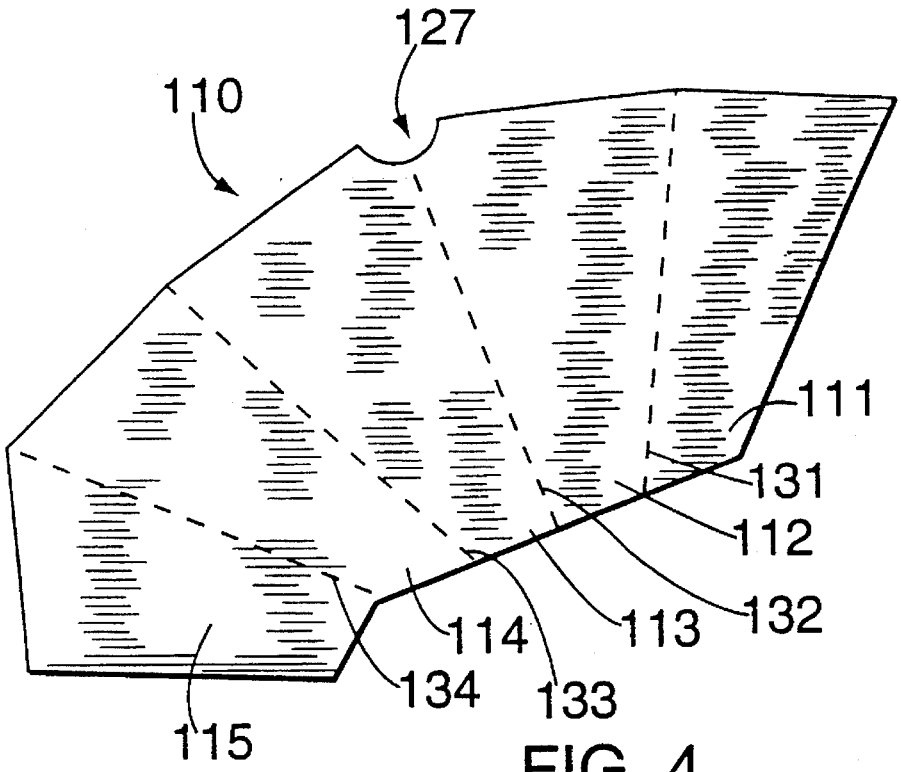
FIG. 4 is a top plan view of the funnel assembly after detachment from the container and prior to folding.

As seen in FIG. 1, the packaging container 100 forms an enclosed box which is suitable for shipping and handling of the motor oil to the ultimate consumer. When the ultimate consumer receives the packaging and takes it to his home for use the container is still completely enclosed, thus preventing dislocation of the containers from the box. Transporting the motor oil is also easily implemented in this fashion. Thereafter, when the user wishes to remove the motor oil containers from the box, one presses down on semi circular portion 120 detaching this section downward and away from the remainder of the funnel assembly 110 and top panel 101. This creates a semi-circular opening 127 as best seen in FIG. 4. Semi-circular opening 127 functions as a handle to insert one's finger into opening 127 and pull upward on funnel assembly 110 to remove it from top panel 101. As noted above, funnel assembly 110 is die cut in a fashion such that assembly 110 can be easily and cleanly removed from top panel 101. However, sufficient connection between funnel assembly 110 and the surrounding portion of top panel 101 are present such that during inadvertent handling and jostling as well as shipping, funnel assembly 110 is unlikely to inadvertently or prematurely separate from the rest of panel 101.

Figure 2:
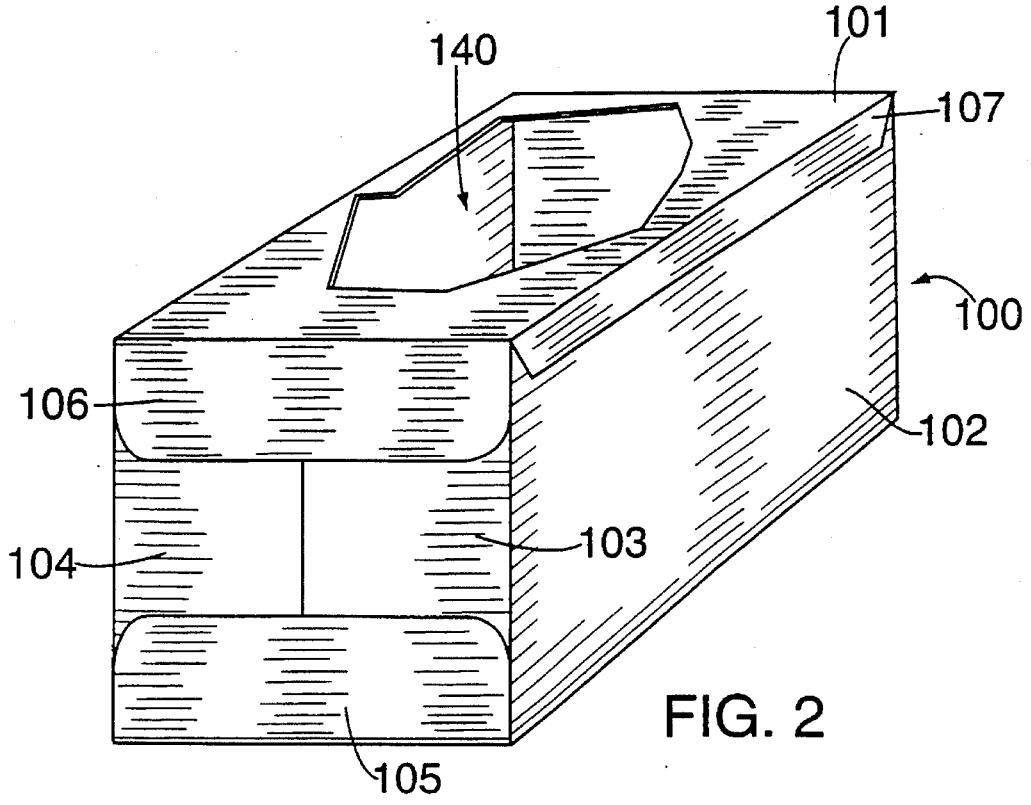
FIG. 2 is a prospective view of the container of FIG. 1 wherein the funnel portion has been removed.

As funnel assembly 110 is removed from top panel 101, container 100 looks as shown in FIG. 2 with an opening 140 in the top panel 101. Opening 140 which has the irregular shape of funnel assembly 110 including semi-circular cut out 120, which is designed to allow the user to gain access to the inside of box 100 and remove the cans or bottles without any further opening to box 100. Even with funnel assembly 110 removed, the structural rigidity of box 100 is essentially unaffected and the opening in top panel 101 provided 140 may be utilized as a handle by the user to grab and carry box 100.

Figure 5:
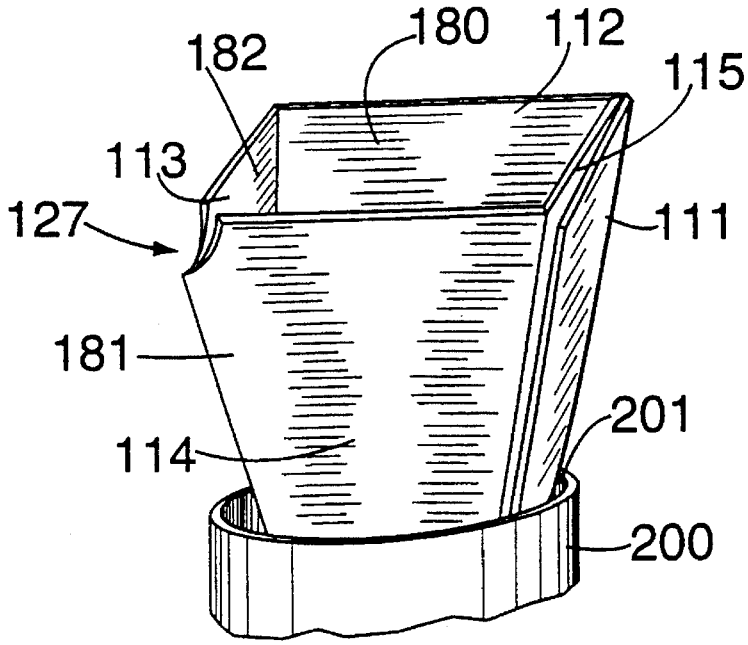
FIG. 5 is cutaway prospective view of the funnel assembled and placed in a crank case opening in accordance with a preferred embodiment of the invention.

Reference is next made to FIGS. 4 and 5 wherein funnel assembly 110 constructed in accordance with the preferred embodiment of the invention is depicted. FIG. 4 shows funnel assembly 110 including panels 111, 112, 113, 114 and 115. Semi-circular cut out 127 is shown resulting from the removal of semi-circular section 120 (FIG. 1). In practice, funnel 110 is assembled by the user whenever it is necessary to pour motor oil into the crank case. As shown in FIG. 5 a crank case 200 having an opening 201, in a conventional fashion is depicted. As better seen in FIG. 5, container 100 is formed of corrugated cardboard in accordance with a preferred embodiment in which a treated surface 180 is present on one surface of die cut panel 130 and an untreated, corrugated cardboard 181 is found on the other surface. The funnel is formed, generally with the treated surface on the inside so that the motor oil does not interact with or soak into the corrugated cardboard. The protective layer may be any plastic, clay, wax or similar protective coating of the type found on containers of various sorts. In the current preferred embodiment the protective coating is formed of a clay coating on the paperboard. The coating may also be a "poly" coating such as polyester, polypropilene or polyvinyl chloride. The funnel is assembled by folding the panels along fold lines 131, 132, 133 and 134 so that an inverted frustumated pyramid is formed having four sides in a generally diamond shaped cross section. Generally, the four side walls of the funnel are formed by panels 112, 113, 114 and overlapped sections 111 and 115. The funnel may be assembled with longer panel 111 on the outside of shorter panel 115 as shown in FIG. 5 or with longer panel 111 inside of shorter panel 115. In either case, the funnel will not remain together unless a rubber band or similar closure is placed around the bottom portion of the funnel 110 or, as shown in FIG. 5, the bottom opening of funnel 110 is inserted into an opening 201 of crank case 200. In practice, this is what would generally be expected, with the funnel placed into opening 201 pressed downward so that it sits firmly in place. The bottom opening of funnel 110 is, like the top opening shown in FIG. 5, generally diamond shaped and of considerably smaller area than the top opening, a characteristic of funnels in general. The wide opening at the top of funnel 110 is designed to ease the flow of the motor oil into crank case opening 201 without spilling or dripping around the opening. Due to the relatively short nature of the funnel the motor oil will tend to drip out of the funnel relatively quickly after it is poured. Thereafter, the funnel can be placed back in box 100 through opening 140 and stored inside box 100 until the next time motor oil must be placed into the car or truck. The funnel 100 will tend to open up and lay flat, easing in storage. Because opening 140 does not cover the entire top of the box, the remaining portions of top panel 101 prevents the unintended movement of the motor oil containers out of the box. Finally, when all the motor oil is used up the box 100, funnel 110 and the empty containers may be disposed of together.

Figure 6:
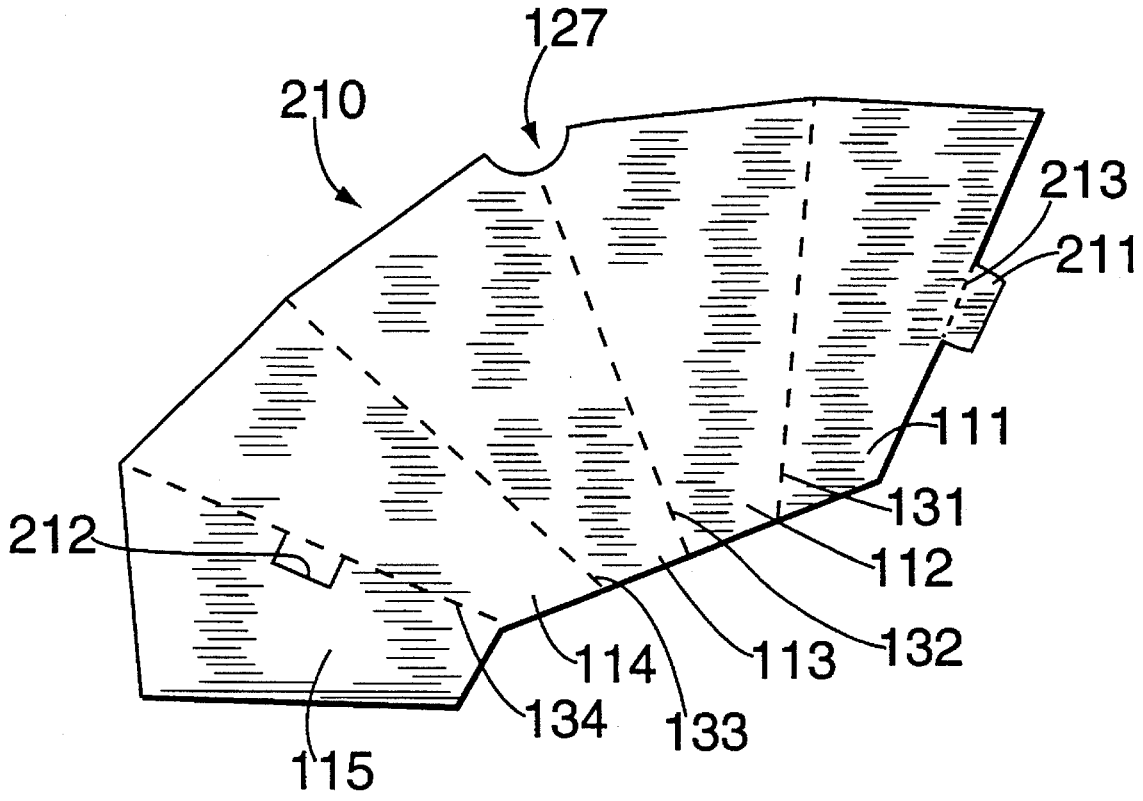
FIG. 6 is a top plan view of a funnel assembly after detachment from a container in accordance with another preferred embodiment of the invention.

Reference is next made to FIG. 6 wherein a funnel assembly, generally indicated as 210 constructed in accordance with another preferred embodiment of the invention is depicted, like reference numerals representing like elements. Funnel assembly 210 includes funnel sections 111–115 with fold lines 131–134, as in the embodiment of FIG. 4. However, in addition to these elements there is a tab 211 extending from panel 111 and a slot 212 die cut in section 115, on fold line 134 between section 114 and 115. Tab 211 is coupled to panel 111 with a fold line 213. Funnel assembly 210 has an interlocking relationship caused by tab 211 and slot 212 so that upon assembly of the funnel 210 tab 211 extends through slot 212 locking the funnel in its assembled condition. In this way, the funnel will maintain its shape even if there is no outside element, such as rubber band or a crank shaft opening, to keep it in its assembled form.

Figure 7:
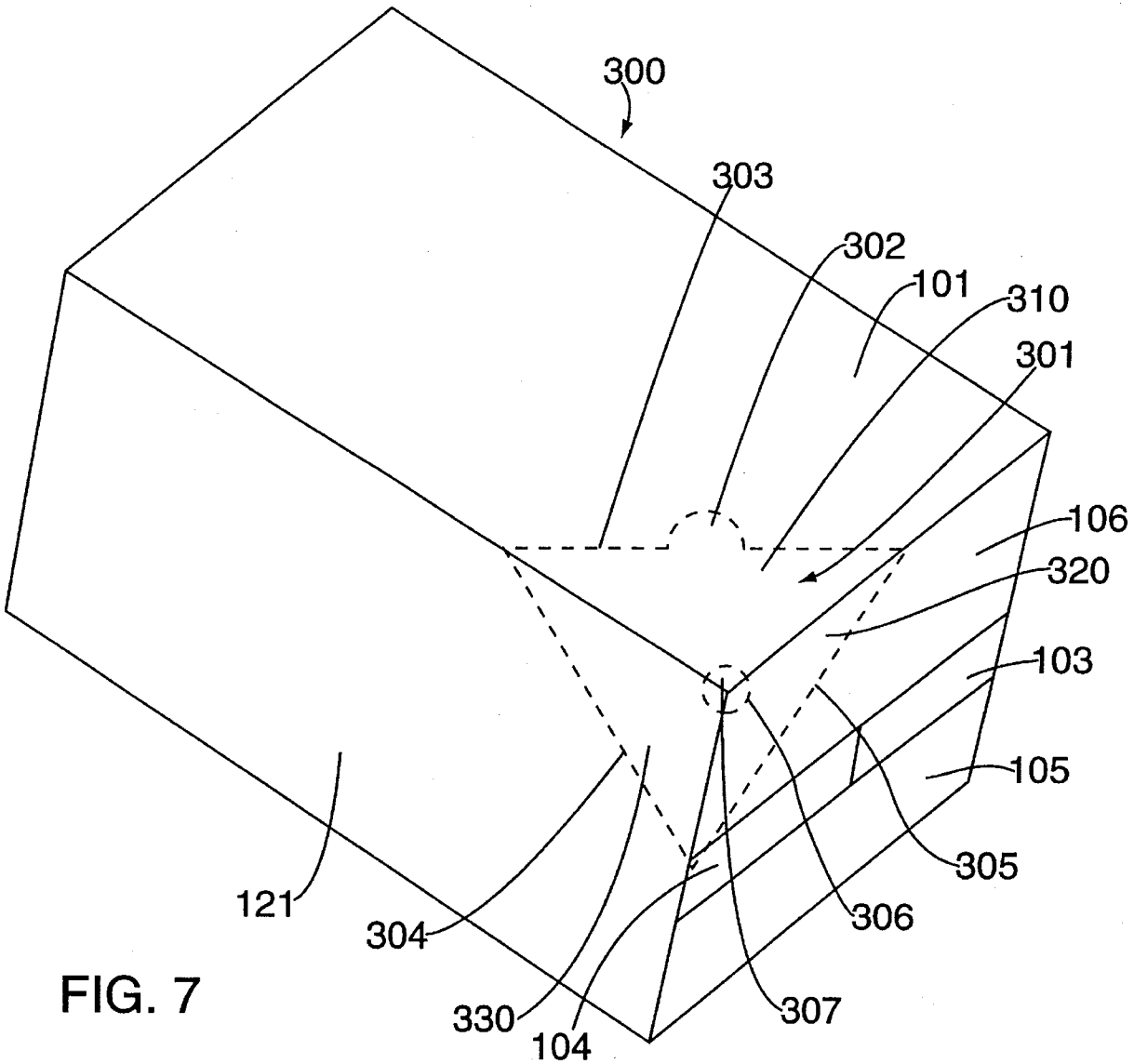
FIG. 7 is a perspective view of a container with an integrated funnel constructed in accordance with another preferred embodiment of the invention.

Reference is next made to FIG. 7 wherein another integrated package and funnel construction, generally indicated as 300 constructed in accordance with another preferred embodiment of the invention is depicted. Like reference numerals represent like numerals. Container 300 is constructed in a similar fashion to the container 100 shown in FIGS. 1, 2 and 3. Top panel 101, side panel 121, horizontal end panels 105, 106 and vertical end panels 103, 104 are likewise incorporated in the construction. However, rather than having the funnel 110 formed entirely out of top panel 101, as shown in FIGS. 1–3, a funnel assembly, generally indicated as 301, is formed from portions of top panel 101, end panels 106 and side panel 121. Funnel assembly 301 is formed from panel 310, 320 and 330. Panel 310 is formed as a portion of top panel 101 by a perforated die cut line 303. Funnel panel 320 is formed out of horizontal end panel 106 by perforated die cut line 305. In one embodiment the die cutting extends only through outer layer 106. In another embodiment the die cutting and perforation extends through end panel 106 and through vertical end panel 104 and even, depending upon the size of funnel 301, end panel 103. Finally, funnel panel 330 is formed from side panel 121 by perforated die cut line 304. In addition, rather than the semi-circular punch-out member 120 in the embodiment of FIGS. 1–3, funnel 301 includes a semicircular region 302 in panel 101. In use, thumb pressure would be applied to this spot, pushing it in and then enabling the removal of funnel assembly 301 along die cut perforated lines 303, 304 and 305. As the container 300 is secured firmly, such as by gluing the panels together, funnel 301 is already in an assembled state and does not need to be folded again by the user. Rather, the initial folding in the container assembly phase folds the funnel into form. Finally, tip portion 307 is removed along perforated die cut line 306 extending around the common corner of panels 101, 106 and 121. While only a single opening die cut 306 is shown, in practice there may be several rings of die cut openings to allow the user to select an appropriate opening size dependent upon the application. In its constructed form, funnel 301 is a triangular frustumated pyramid.

There is no need for the user to separately dispose of the funnel or store it in a separate location apart from the container 100. Because the funnel is made of corrugated cardboard in a preferred embodiment it may be quickly and conveniently recycled without difficulty.

While in the current best mode of the invention the container is formed of corrugated cardboard it may be formed of other sheet material which may be die cut similarly formed such as plastic sheets or similar material. In addition, the form of funnel 110 may be altered depending upon the needs of the materials stored within the container.

Also, the characteristics of the coating may be altered to optimize the flow characteristics of funnel 110. Also, while the funnel assembly 110 is shown as being cut from the top panel of the box in the preferred embodiment, it may also be cut from, for example a side panel which would allow for a larger funnel having a greater opening area and/or a greater narrowing profile. In addition it can be cut from several panels to make an even larger funnel. While the preferred embodiment of the funnel is formed from five panels overlapped to form a four sided inverted pyramidal thrust, alternate geometrical arrangements are possible in which more or less panels are utilized.

Accordingly, an improved integrated packaging and funnel construction is provided. The integrated packaging funnel construction incorporates a funnel into the packaging for motor oil or other liquids or powdered materials to enhance the usability of the materials and avoid spillage without the need for a separate funnel to be purchased and then separately stored. The funnel assembly is also recyclable with the packaging and enhances the value of the motor oil to the consumer.

While the above discussion has been with reference to motor oil the construction is suitable for other automotive liquids such as transmission fluid, break fluid, engine coolants, windshield washer fluid and the like. It is also applicable to use in non-automotive uses for transmission of large containers of liquid or powdery materials which are shipped in large, environmentally conscious sizes such as shampoos, detergents and food stuffs such as grains or cereals. This enables the pouring from the larger container into a small opening, for example into a smaller container with the funnel being formed of the packaging and easy to store thereafter within the packaging for continued use and disposal following depletion of the materials within the larger container.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. An integrated packaging system for containers of pourable materials, comprising:

a top panel;

a bottom panel;

at least two side panels, attached to the top and bottom panels;

at least two end panels, attached to the top and bottom panels;

the top, bottom, side and end panels forming a box for enclosing the containers of pourable material; and funnel means, formed from at least one of the top, bottom, side and bottom panels, for forming a funnel to aid in pouring the pourable materials from the containers, said funnel means being adapted to be separated from the at least one of the top, bottom, side and bottom panels, the funnel means having fold lines for enabling folding into a frustumated pyramidal shape with a first opening and a second opening, the first opening being larger than the second opening and the first and the second openings being at opposite ends of the funnel;

whereby an integrated packaging system formed including a box with a funnel for pouring the contents of the containers is provided.

2. The integrated packaging system of claim 1, wherein the top, bottom, side and end panels are formed of corrugated cardboard sheets.

3. The integrated packaging system of claim 2, wherein the top, bottom, side and end panels are formed as a single sheet.

4. The integrated packaging system of claim 3, wherein the single sheet is divided into the top, bottom, side and end panels by pre-marked fold lines defining the dimensions of each of the top, bottom, side and end panels and enabling folding of the sheet into an assembled box.

5. The integrated packaging system of claim 4, further including end flaps extending from the top and bottom panels and a top flap extending from the top panel.

6. The integrated packaging system of claim 5, wherein the end flaps are coupled to the end panels and the top flap is coupled to a side panel.

7. The integrated packaging system of claim 1, wherein the funnel means is formed out of the top panel.

8. The integrated packaging system of claim 1, wherein the funnel means is formed out of the top panel, one side panel and one end panel.

9. The integrated packaging system of claim 1, wherein the funnel means is die cut so that it may be removed from the panel or panels from which it is formed with controlled pressure.

10. The integrated packaging system of claim 1, further including funnel removing means, formed directly adjacent to the funnel means from at least one of the top, bottom, side and bottom panels, for simplifying the removal of the funnel means from the at least one of the top, bottom, side and bottom panels in which it is formed.

11. The integrated packaging system of claim 10 wherein the funnel removing means is formed in the shape of a semicircle which is adapted to be removed by being pushed into the interior of the box.

12. An integrated packaging system for motor oil containers, comprising:

a top panel;

a bottom panel;

at least two side panels, attached to the top and bottom panels;

at least two end panels, attached to the top and bottom panels;

the top, bottom, side and end panels forming a box for enclosing the motor oil containers; and funnel means, formed from at least one of the top, bottom, side and bottom panels, for forming a funnel to aid in pouring the motor oil from the containers, said funnel means being adapted to be separated from the at least one of the top, bottom, side and bottom panels, the funnel means having fold lines for enabling folding into a frustumated pyramidal shape with a first opening and a second opening, the first opening being larger than the second opening and the first and the second openings being at opposite ends of the funnel;

whereby an integrated packaging system formed including a box with a funnel for pouring the motor oil from the containers is provided.

13. The integrated packaging system of claim 12, wherein the top, bottom, side and end panels are formed of corrugated cardboard sheets.

14. The integrated packaging system of claim 13, wherein the bottom, side and end panels are formed as a single sheet.

15. The integrated packaging system of claim 14, wherein the single sheet is divided into the top, bottom, side and end panels by pre-marked fold lines defining the dimensions of each of the top, bottom, side and end panels and enabling folding of the sheet into an assembled box.

16. The integrated packaging system of claim 15, further including end flaps extending from the top and bottom panels and a top flap extending from the top panel.

17. The integrated packaging system of claim 16, wherein the end flaps are coupled to the end panels and the top flap is coupled to a side panel.

18. The integrated packaging system of claim 12, wherein the funnel means is formed out of the top panel.

19. The integrated packaging system of claim 12, wherein the funnel means is formed out of the top panel, one side panel and one end panel.

20. The integrated packaging system of claim 12, wherein the funnel means is die cut so that it may be removed from the panel or panels from which it is formed with controlled pressure.

21. The integrated packaging system of claim 12, further including funnel removing means, formed directly adjacent to the funnel means from at least one of the top, bottom, side and bottom panels, for simplifying the removal of the funnel means from the at least one of the top, bottom, side and bottom panels in which it is formed.

22. The integrated packaging system of claim 21 wherein the funnel removing means is formed in the shape of a semicircle which is adapted to be removed by being pushed into the interior of the box.

23. The integrated packaging system of claim 12 wherein the funnel means includes a protective layer on at least one surface of the funnel means to prevent interaction of the motor oil with the funnel means when the motor oil is poured through the funnel.

24. A sheet for forming an integrated packaging system and funnel, comprising:

a series of fold lines defining, a top panel, bottom panel, at least two side panels and at least two end panels which can be folded and assembled into a box;

a partially die-cut section formed, from at least one of the top, bottom side and/or end panels, into a funnel assembly; and a series of fold lines in the funnel assembly adapted to enable folding of the funnel assembly into a funnel;

whereby the sheet forms a packaging system in the form of a box with a funnel incorporated into one or more panels of the box which is selectively removable.

25. The sheet of claim 24 further including a partially die cut funnel removal section for aiding in the removal of the funnel assembly from the sheet.

26. The sheet of claim 24 wherein the fold lines define four vertically oriented end panels and four horizontally oriented end panels.

27. The sheet of claim 24 wherein the fold lines also define a top panel flap.

28. The sheet of claim 24 wherein the funnel assembly is formed in the top panel.

29. The sheet of claim 24, further including a protective layering on at least one surface of the funnel assembly.

30. The sheet of claim 29, wherein the protective layering is on the inside of the funnel.

* * * * *